US006428457B1

(12) United States Patent
Fukuda et al.

(10) Patent No.: US 6,428,457 B1
(45) Date of Patent: Aug. 6, 2002

(54) FORMER FOR A BAG MAKER

(75) Inventors: Masao Fukuda, Shiga (JP); Keiichi Nishimura, Berkeley, CA (US)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 08/537,143

(22) Filed: Sep. 29, 1995

(51) Int. Cl.[7] ..... B65B 9/12; B65B 51/30

(52) U.S. Cl. ..... 493/302; 493/308; 53/551; 53/552

(58) Field of Search ..... 493/269, 295, 493/302, 304, 308, 417; 53/551, 552, 554

(56) References Cited

U.S. PATENT DOCUMENTS

| | | | | | |
|---|---|---|---|---|---|
| 2,940,408 | A | * | 6/1960 | Monsees et al. | 29/557 |
| 2,982,334 | A | * | 5/1961 | Cooper et al. | 100/305 |
| 3,070,931 | A | * | 1/1963 | Zwight | 53/552 |
| 3,122,072 | A | * | 2/1964 | Monsees et al. | 493/302 |
| 3,127,819 | A | * | 4/1964 | Woolsey | 493/302 |
| 3,415,171 | A | * | 12/1968 | Wilson | 493/302 |
| 3,494,265 | A | * | 2/1970 | Middour | 493/302 |
| 3,636,826 | A | | 1/1972 | Bowen et al. | |
| 4,007,576 | A | * | 2/1977 | Metz | 53/552 |
| 4,043,098 | A | * | 8/1977 | Putnam, Jr. et al. | 493/302 |
| 4,171,605 | A | * | 10/1979 | Putnan, Jr. et al. | 53/552 |
| 4,909,017 | A | * | 3/1990 | McMahon et al. | 53/551 |
| 4,950,345 | A | * | 8/1990 | Kreager, Jr. et al. | 493/302 |
| 4,986,054 | A | * | 1/1991 | McMahon | 53/552 |
| 4,991,379 | A | * | 2/1991 | Boeckmann | 53/552 |
| 5,054,270 | A | * | 10/1991 | McMahon | 53/552 |
| 5,127,208 | A | * | 7/1992 | Custer et al. | 493/302 |
| 5,237,798 | A | * | 8/1993 | Fukuda | 53/551 |
| 5,279,098 | A | * | 1/1994 | Fukuda | 53/552 |
| 5,347,795 | A | * | 9/1994 | Fukuda | 53/552 |
| 5,400,565 | A | * | 3/1995 | Terminella et al. | 53/552 |
| 5,400,568 | A | * | 3/1995 | Kanemitsu et al. | 53/552 |
| 5,548,947 | A | * | 8/1996 | Fincham et al. | 53/551 |

FOREIGN PATENT DOCUMENTS

| | | |
|---|---|---|
| GB | 913114 | 7/1959 |

* cited by examiner

*Primary Examiner*—Darren W. Ark
(74) *Attorney, Agent, or Firm*—Beyer Weaver & Thomas, LLP

(57) ABSTRACT

A former for forming an elongated planar bag-making material into a tubular form is composed of a hollow cylindrical tubular part and a shoulder part which has a planar guide section and is connected to the tubular part along a connecting line surrounding the tubular part. Both the tubular and shoulder parts are formed by cutting a tube-forming piece and a shoulder-forming piece from a flat blank sheet in appropriate shapes and bending these pieces into the shapes of the tubular and shoulder parts. The connecting line is designed such that the angle between its tangent and the axial direction of the tubular part changes at a constant rate. Portions of the edges of the tube-forming and shoulder-forming pieces may be in a shape of a parabola or a hyperbolic function curve, and these pieces are obtained by making a numerical control program from the desired shapes of the curve and controlling a laser cutter by the program to cut a blank sheet in the desired shapes.

14 Claims, 4 Drawing Sheets

FORMER FOR A BAG MAKER

BACKGROUND OF THE INVENTION

This invention relates to a former for a bag maker and packaging machines incorporating such a former.

A bag maker-packaging machine, such as a vertical pillow-type form-fill-seal packaging machine as disclosed, for example, in U.S. Pat. No. 5,237,798 issued Aug. 24, 1993, makes use of a component commonly known as a former for bending an elongated flexible bag-making material into a cylindrical form, generally composed of a vertically extending tubular part and a so-called shoulder part (sometimes also called a skirt-like part) having a sloped planar guide section. The bag-making material, say, in the form of a web, is longitudinally transported towards the former horizontally in a flat form, moves over and along this sloped planar guide section of the shoulder part, changes the direction of its motion sharply as it crosses the connecting line at which the tubular and shoulder parts are attached together so as to move inside the tubular part and is pulled downward axially along the inner surface of the tubular part. In other words, the bag-making material is pushed upwards first over the sloped planar guide section of the shoulder part, changes the direction of its motion sharply at the connecting line as it is folded into a tubular form, and then is pulled downward by the force not only of the articles which are dropped in to be packaged in the bag being made but also of a pull-down belt or the like (not shown) for causing the motion of the bag-making material. Thus, it is crucial that the connecting line, at which the bag-making material is forced to change the direction of its motion sharply, be a continuous smooth curve shaped correctly because, if it is not shaped correctly or has even a small unevenness, the material is likely to become wrinkled or develop small longitudinal lines on the surface.

Formers of this type are usually produced by casting, a master mold being used thereafter to carry out an accurate copy process for shaping the connecting line correctly. This, however, requires a long time of hard work by an experienced worker, adding to the production cost, and fluctuations and non-uniformity in the shape of formers make them non-exchangeable. Moreover, many formers are usually required for producing bags of different sizes. Even when bags of the same size are produced, different formers are generally required, depending upon where and how the side edges of the elongated bag-making material should be overlapped for longitudinal sealing. The angle of the sloped planar guide section of the shoulder part must be changed, furthermore, depending on the physical properties of the bag-making material such as its thickness. In short, the cost of equipping a bag maker with a sufficient number of formers with different kinds is substantial if prior art technology is relied upon.

SUMMARY OF THE INVENTION

It is therefore an object of this invention to provide a method of producing formers of different kinds accurately and automatically.

It is another object of this invention to provide formers produced by such a method, having their tubular and shoulder parts formed by bending pieces which are cut from a blank sheet by a numerically controlled cutting machine.

A former according to the present invention, with which the above and other objects can be accomplished, may be characterized not only as being composed of a hollow cylindrical tubular part defining an axial direction and a shoulder part which has a planar guide section and is attached to the tubular part along a closed three-dimensional line (referred to as the connecting line) such that an elongated bag-making material transported over the sloped planar guide section of the shoulder part can be made into a tubular form as it crosses the connecting line to move into the tubular part, but wherein the aforementioned connecting line between the tubular and shoulder parts is shaped such that the angle between its tangent and a plane perpendicular to the axial direction of the tubular part changes at a constant rate with respect to the change in position of the contact point of the tangent with the connecting line, for example, in the direction perpendicular to the axial direction of the tubular part or along the connecting line itself.

To produce such a former according to the present invention, pieces to be made into the tubular and shoulder parts are cut out from a blank sheet in specified geometrical shapes, bent and folded appropriately into predetermined shapes of the tubular and shoulder parts, and attached together, say, by welding, along the aforementioned connecting line. The geometrical shapes into which the blank sheet is cut are determined such that, when these pieces are bent, folded and attached together as described above, the connecting line therebetween will satisfy the condition imposed according to this invention as described above regarding the rate of change in its slope.

Depending upon what kind of seals are desired, side strips of different widths may be provided along the side edges of the pieces to be cut out from the blank sheet.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
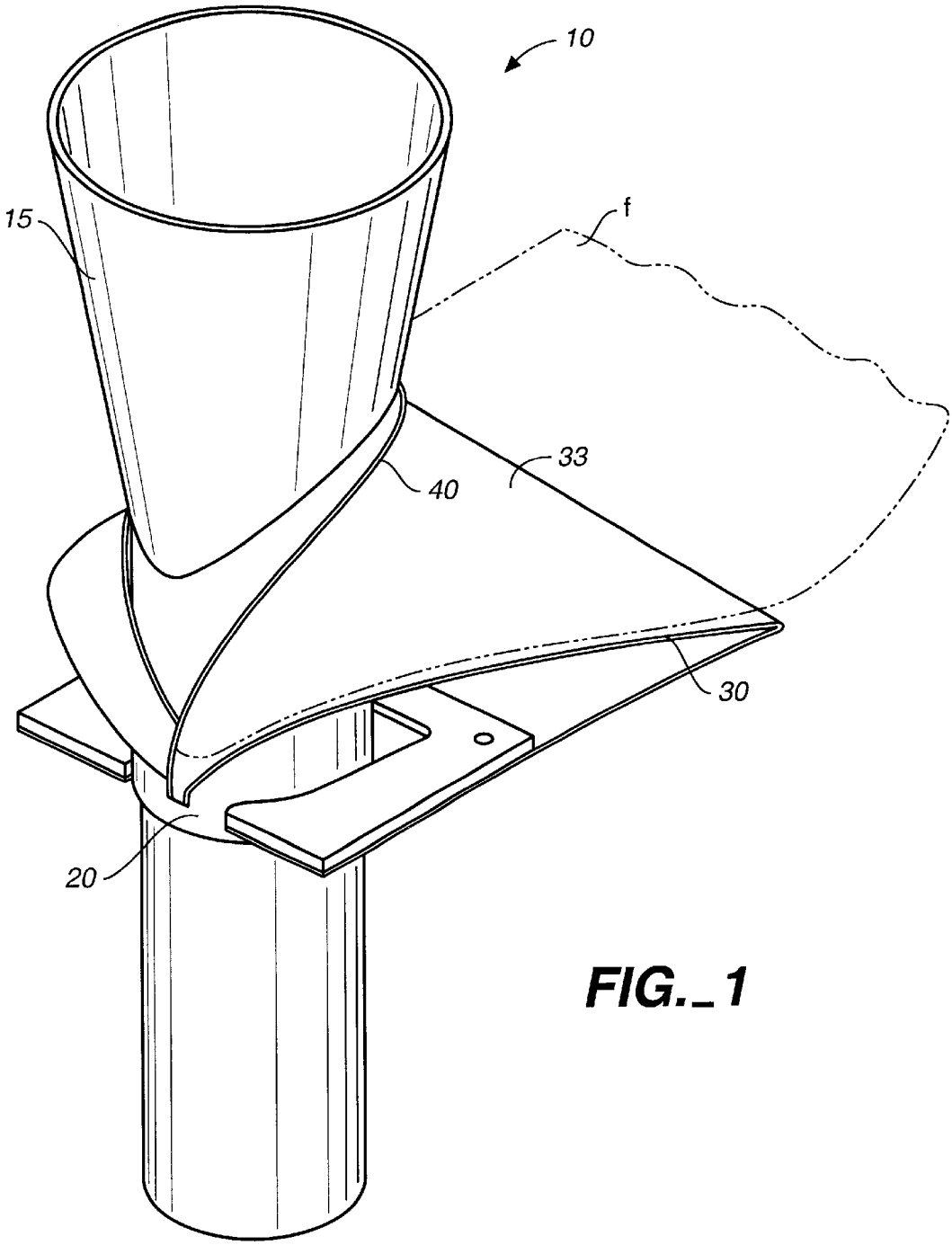
FIG. 1 is a view of a former according to the present invention as a part of a vertical pillow type bag maker-packaging machine.

FIG. 1 shows at 10 an example of formers according to the present invention, comprised essentially, like a prior art former, of a hopper 15, a tubular part 20 and a shoulder part 30 which are attached to each other. The three-dimensionally curved closed line along which the tubular part 20 and the shoulder part 30 will be referred to as a connecting line 40 (and also indicated by letter Q).

Figure 2A:
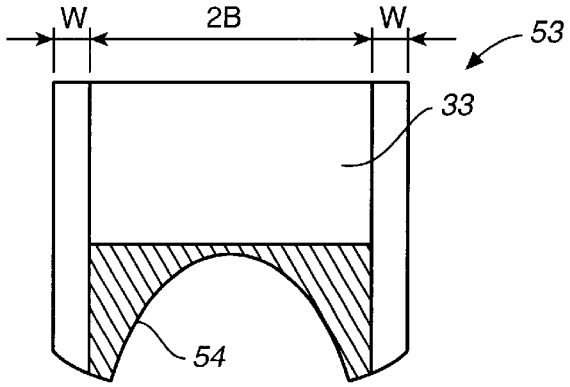
FIGS. 2A and 2B are plan views of portions of a blank sheet material cut respectively for forming a shoulder part and a tubular part of a former according to this invention.
Figure 2B:
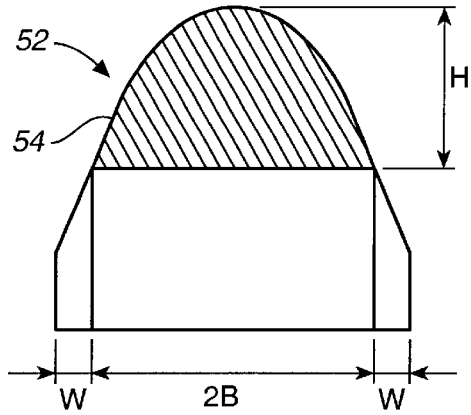

To form the tubular part 20 and the shoulder part 30, a blank sheet material is cut into specified geometrical shapes as shown in FIGS. 2A and 2B, bending them and attaching them together. For the purpose of description, the pieces of a blank sheet thus cut out are herein referred to as the tube-forming piece 52 and the shoulder-making piece 53, respectively.

Figure 3A:
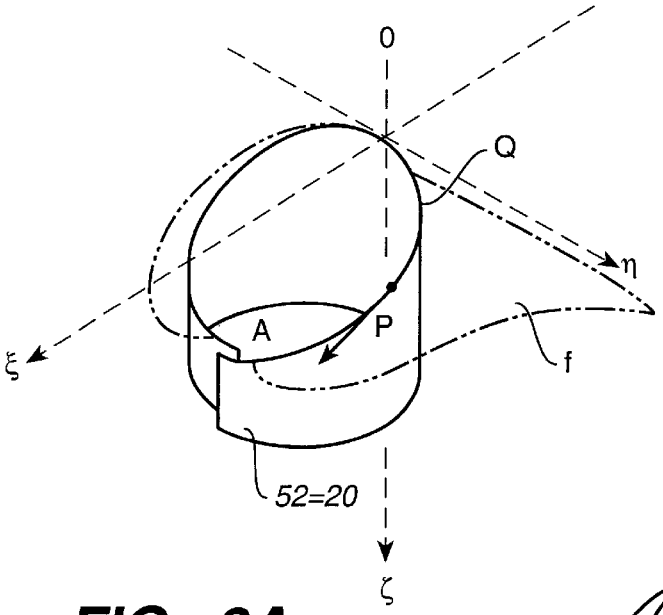
FIGS. 3A and 3B are diagonal external views of two tube-forming pieces about to be made into a tubular part of a former.

FIG. 3A shows how the tube-forming piece shown in FIG. 2B may be bent into a tubular form to form the tubular part 20. It is to be noted that both the tube-forming and shoulder-forming pieces 52 and 53 have a curved edge section 54. When the tube-forming and shoulder-forming pieces 52 and 53 are bent to form the tubular and shoulder parts 20 and 30, their curved edge sections 54 become the connecting line 40, along which the tubular and shoulder parts 20 and 30 are attached together. The desired shape of the connecting line 40, and the problem of how to determine the shape of the curved edge section 54 when the tube-forming and shoulder-forming pieces 52 and 53 are cut out, will be discussed next.

Roughly described, the tubular part 20 is of the shape of a cylinder which has been cut by a sloped plane, as shown both in FIGS. 1 and 3A. For the sake of description, let us assume that the tubular part 20 is standing up vertically, or that it has a vertical axial direction, as shown in FIG. 3A with the highest and lowest points on the connecting line Q indicated by letters O and A, respectively. For convenience, a three-dimensional rectilinear coordinate system with mutually perpendicular $\xi$, $\eta$ and $\zeta$-axes is defined, as shown in FIG. 3A, with the origin at O, the $\zeta$-axis extending vertically downward, the lowest point A of the connecting line Q being on the $\xi\zeta$-plane. The $\xi\eta$-plane will be also referred to as the horizontal plane, and the projection of the cylindrical form of the tubular part 20 onto the horizontal plane will be referred to as the cross-section curve. Cross-section curves which are symmetric with respect to the $\xi$-axis, such as a circle, and connecting lines which are symmetric with respect to the $\xi\zeta$-plane will be considered throughout herein, although this is not intended to limit the scope of the invention.

Figure 4:
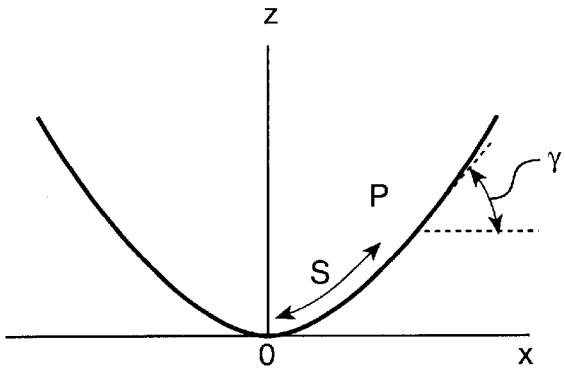
FIG. 4 shows a curve representing the curved edge sections of FIGS. 2A and 2B.

FIG. 4 shows the shape of the curved edge section 54, that is, the portion of the tube-forming piece 52 which, when bent, will form the connecting line Q. In other words, FIG. 4 shows the curve which will be obtained, corresponding to the connecting line Q, if the tubular part 20 shown in FIG. 3A is unbent and flattened. This two-dimensional curve, representing the aforementioned curved edge sections 54, will be hereinafter referred to as the edge curve, and a two-dimensional rectilinear coordinate system with mutually perpendicular x and z-axes is defined, for convenience as shown in FIG. 4, with the z-axis coinciding with the $\zeta$-axis and the origin O at the same position as shown in FIG. 3A.

Broadly stated, the goal of this invention is to properly design the edge curve such that a bag-making material (as indicated by letter f in FIG. 1) will smoothly change the direction of its motion as it is pulled across the connecting line Q. It therefore goes without saying that the edge curve in FIG. 4 should be a smoothly bending curve. This condition alone, however, is not sufficient to determine the shape of the curve. According to this invention, the connecting line Q is required to change its slope uniformly. Stated more precisely, the angle between the tangent to the connecting line Q and the horizontal plane is required to change at a constant rate.

According to one embodiment of this invention, the aforementioned constant rate is with respect to the x-coordinate of the contact point at which the connecting line Q and its tangent contact each other. In other words, slope of the tangent of the connecting line Q must change at a constant rate with respect the perpendicular component of change in position of the contact point between the connecting line Q and its tangent with respect to the axial direction of the tubular part 20. If an arbitrary point on the connecting line Q is denoted by P, the slope as defined above at point P is the tangent of angle $\gamma$ indicated in FIG. 4. Thus, since $\tan\zeta = dz/dx$ if $z=z(x)$ is the equation of the edge curve shown in FIG. 4, the condition imposed according to the first embodiment of the invention can be written as:

$$d(dz/dx)/dx = a(\text{constant}). \tag{1}$$

Because the connecting line Q is required to be smooth and symmetric with respect to the $\xi\zeta$-plane, $\tan\zeta=0$ when $x=0$, and hence one obtains by integrating (1) once:

$$dz/dx = ax. \tag{2}$$

If the height difference between points O and A, or the distance between them along the $\zeta$-axis, is denoted by H and the width of the bag to be formed by the former is denoted by B, as shown in FIGS. 2A and 2B, one obtains by integrating (2):

$$z = (H/B^2)x^2, \tag{3}$$

that is, the edge curve shown in FIG. 4 should be a parabola.

If the cross-section curve is a circle of radius r ($=B/\pi$), as a special example, the $\xi$-coordinate and the x-coordinate of the arbitrary point P on the connecting line Q are related by:

$$\xi = r(1-\cos(x/r)) \tag{4}$$

and hence:

$$d\zeta/d\xi = (dz/dx)(dx/d\xi) = -(2Hx/B^2)/\sin(x/r). \tag{5}$$

Thus, the angle between the $\xi$-axis and the projection of the connecting line Q at the highest point O of the connecting line Q is given by:

$$\tan^{-1}(2Hr/B^2) = \tan^{-1}(2H/\pi^2 r). \tag{6}$$

According to another embodiment of this invention, the aforementioned constant rate is along the connecting line Q itself. If the distance of the arbitrary point P from the origin O along the connecting line Q (or the edge curve) is denoted by s, as shown in FIG. 4, this condition translates into:

$$d(\tan\gamma)/ds = d(dz/dx)/ds = a(\text{constant}). \tag{7}$$

Since $ds=\{1+(dz/dx)^2\}^{1/2}dx$, (7) can be rewritten as follows, if one sets $y=dz/dx$:

$$dy/ds = (dy/dx)(dx/ds) = (dy/dx)/(1+y^2)^{1/2} = a. \tag{8}$$

If (8) is integrated with the condition that $y=0$ when $x=0$, $$\log\{y+(1+y^2)^{1/2}\} = ax. \tag{9}$$

This has the following as solution:

$$y = dz/dx = \sin h(ax). \tag{10}$$

If (10) is integrated with the condition that $z=0$ when $x=0$, one obtains the following as the equation of the edge curve:

$$z = (\cos h(ax)-1)/a. \tag{11}$$

This result, too, is independent of the shape of the cross-section curve.

The portion of the shoulder part 30 corresponding to the connecting line Q is shaped identically. It must be so since each part of the bag-making material f must travel the same distance before and after it is transformed into a tubular shape.

Figure 5:
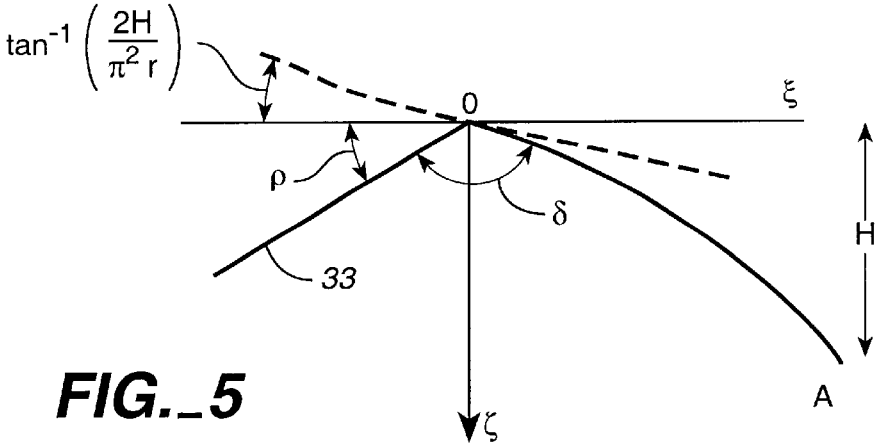
FIG. 5 is a projection of the former according to this invention onto the $\xi\zeta$-plane.

As shown in FIG. 1, the shoulder part 30 has a sloped planar guide section 33 over which the bag-making material f is caused to slide upward before the direction of its motion is suddenly changed downward when it reaches the connecting line 40. The angle of this planar guide section 33 with the horizontal direction is denoted by ρ in FIG. 5. FIG. 5 also shows the projection of the connecting line Q onto the ξζ-plane.

If the cross-section curve is a circle, the angle δ between this sloped planar guide section 33 of the shoulder part 30 and the projection of the connecting line Q onto the ξζ-plane is given, from (6), by:

$$\delta=\pi-\rho-\tan^{-1}(2H/\pi^2 r). \quad (12)$$

It was found experimentally that good results are obtained if δ is about 110°, or 11π/18. If this is substituted into (12), one obtains:

$$H=(\pi^2 r/2)\tan\{(7\pi/18)-\rho\}. \quad (13)$$

If the angle ρ of the sloped planar guide section 33 is set equal to π/4, as a typical example, $H=0.233\pi n^2 r$. Thus, it becomes possible to design standardized formers.

Figure 3B:
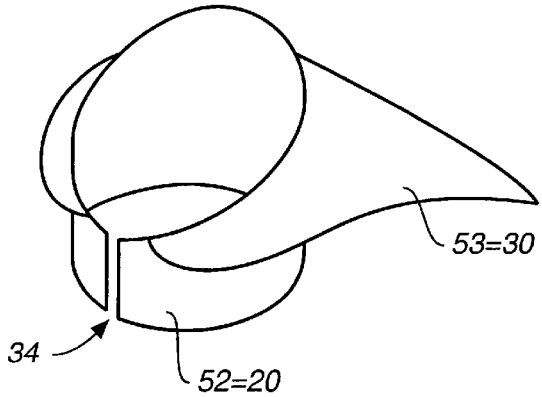
Figure 6A:
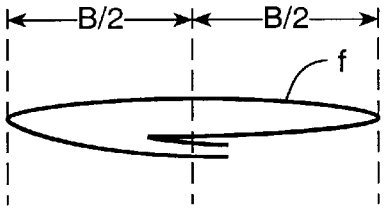
FIGS. 6A, 6B, 6C and 6D are sketches of different ways of making a longitudinal seal to make bags.
Figure 6C:
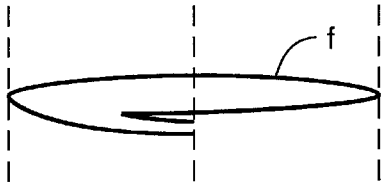
Figure 6B:
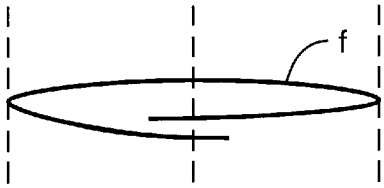
Figure 6D:
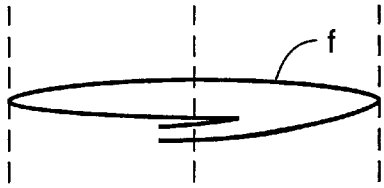

After the longitudinally elongated bag-making material f is bent into a tubular form by the former, its side edges are overlapped and stuck together. As shown in FIGS. 6A, 6B, 6C and 6D, however, there are many different ways of carrying out this longitudinal sealing process. FIG. 6A shows a standard fin seal whereby the inner surfaces of both side edges of the material are stuck together and the two side edges are then folded in one direction. FIG. 6B shows a lap seal, which is also sometimes called an envelope seal, whereby the inner surface of one side edge is stuck to the outer surface of the other edge. Depending on which kind of seal is desired, both the positions and the widths of the joined areas must be differently determined. FIG. 6C shows a kind of offset seal whereby the overlapped edges are folded in one direction such that either the fold line or the outer edges will be at the center in the direction of the width of the bag. In this case, too, both the positions and the widths of the areas for making the joint change, depending upon the kind of the seal. FIG. 6D shows still another seal whereby the edges are folded in the reverse direction after a fin seal has been made. When the tube-forming piece is bent to form the tubular part, its side edge parts are either overlapped as shown in FIG. 3A or made to form a flat part 34 as shown in FIG. 3B such that a pair of mutually opposite vertical sealers (not shown) can be used to form a fin seal. In summary, the width W of the narrow strip for making an overlap, when a blank sheet is cut as shown in FIGS. 2A and 2B, should be determined, depending upon what kind of sealing is intended when bags are formed at a later stage after the bag-making material f is bent into a tubular form by the former.

After the width W of the overlap is thus determined and the constants in (3) or (11) are determined for the connecting part, for example, on the basis of the size of the bags to be made, the shape as shown in FIGS. 2A and 2B, in which the blank sheet should be cut, is determined. In accordance, a CAD/CAM system may be used to create a numerical control program automatically on the basis of such determinations as well as physical properties of the blank sheet such as its thickness. A numerically controlled laser cutter is operated by such a program to cut a blank sheet as shown in FIGS. 2A and 2B in single strokes and obtain pieces to be bent to make the tubular and shoulder parts. These parts are positioned next to each other along their connecting lines and welded together to build a former as shown in FIG. 1.

The invention was described above with reference to only two examples wherein the constant rate of change in the slope of the connecting line Q was with reference either to the x-axis or along the connecting line Q itself (or with reference to the variable s), but these examples are not intended to limit the scope of the invention. In the case of the illustrated examples, however, the shape of the curved edge section of the tube-forming and shoulder-forming pieces can be written in a closed form in terms of a known function, and this makes it easier to produce the numerical control program accurately for the means such as a laser cutter for cutting a blank sheet to obtain the tube-forming and shoulder-forming pieces.

As for the cross-sectional shape of the tubular part, it is not required to be circular. For making relatively large bags, for example, a somewhat elongated circular shape may be preferred such as a shape comprised of two semi-circles connected with two straight side lines or an elliptical cross-sectional shape. Since the condition imposed upon the shape of the connecting line according to this invention does not depend upon the cross-sectional shape of the tubular part, the present invention, as described above, is applicable to tubular parts with different cross-sectional shapes.

Figure 7:
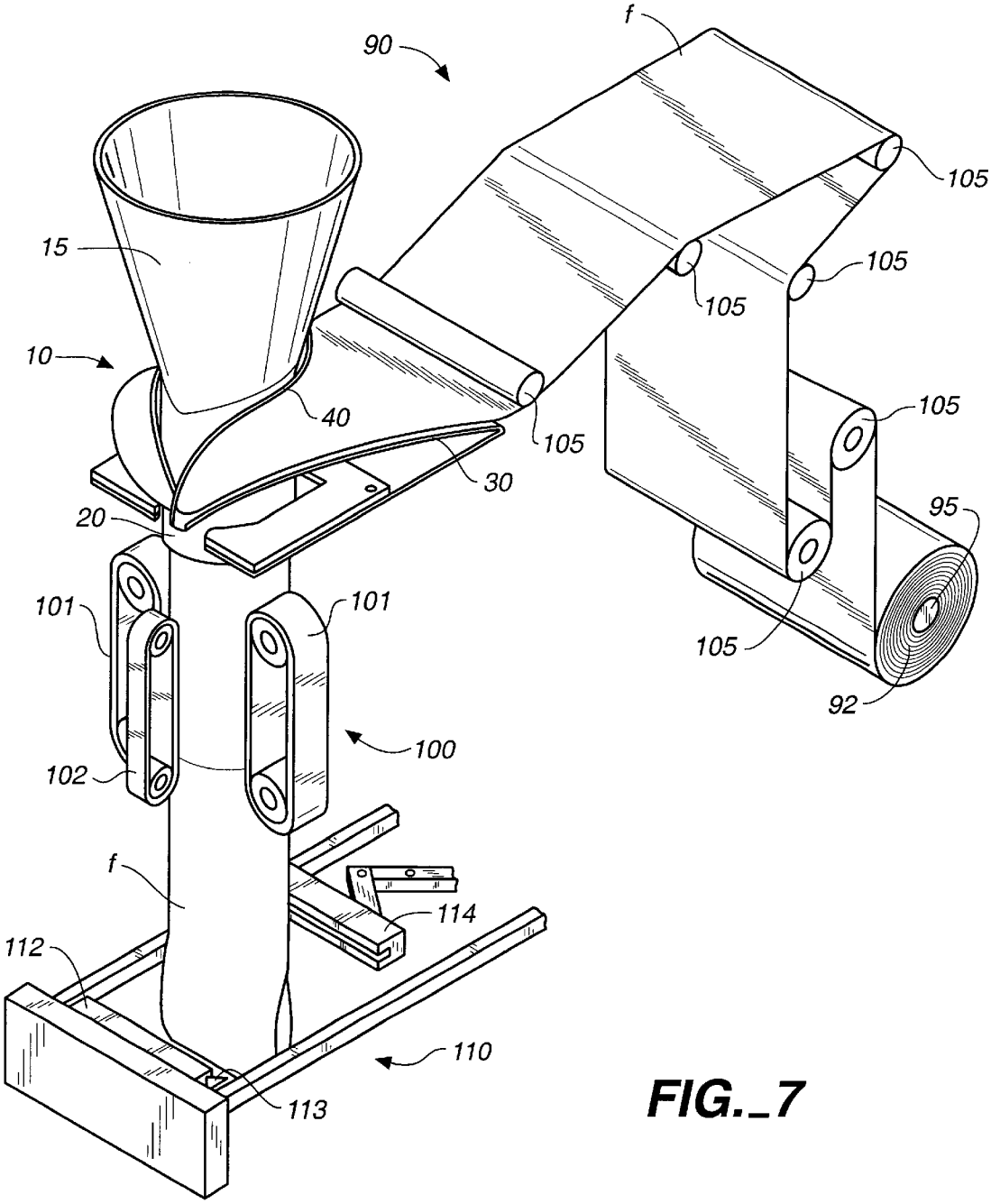
FIG. 7 is a schematic diagonal view of a portion of a packaging machine of a form-fill-seal type incorporating the former of FIG. 1.

FIG. 7 shows a vertical pillow type form-fill-seal packaging machine 90 as an example of packaging machines which may incorporate a former according to this invention. The flexible thermoplastic bag-making material f (or a film) is originally in the form of a web roll 92 supported around a shaft 95 (serving as web supporting means). The film f, pulled out of the web roll 92, is guided by a plurality of guide rolls (including dancer rollers) 105 to the former 10 as described above with reference to FIG. 1. After the film f is thereby formed into a tubular shape, by sliding on the shoulder part 30 and changing the direction of its motion at its connecting line 40 with the tubular part 30, it is pulled downward by a film-pulling unit 100 including a pair of pull-down belts 101 which run parallel to each other and a longitudinal sealer in the form of a heater belt 102 for sealing together the mutually overlapping edge portions of the film f. The film f, which is now in a cylindrical form, is sealed horizontally (that is, transversely to its downward direction of motion) by a transverse sealer 110, as articles to be packaged are dropped from the hopper 15. The transverse sealer 110 may be of a design provided with a fixed seal jaw 112 and a mobile seal jaw 114 both of a known structure and disposed below the film-pulling unit 100. In FIG. 7, numeral 113 indicates a blade for cutting the film f transversely between the bags into which the film f has been formed.

It is to be noted that formers according to this invention can be incorporated in many other kinds of packaging machines and bag makers where it is required to bend a longitudinally traveling flexible bag-making material into a tubular form.

What is claimed is:

1. A former for forming an elongated planar bag-making material into a tubular form, said former comprising:

a hollow cylindrical tubular part having an inner surface and defining an axial direction; and a shoulder part which has a planar guide section and is connected to said tubular part along a connecting line which surrounds said tubular part such that said material is transported over said planar guide section of said shoulder part, changes direction of motion sharply at said connecting line into said axial direction and is transformed into a tubular form along said inner surface of said tubular part, the angle between a tangent to said connecting line tangentially contacting said connecting line at a contact point and a plane perpendicular to said axial direction changing at a constant rate.

2. The former of claim 1 wherein said constant rate is with respect to the perpendicular component of change in position of said contact point between said connecting line and said tangent with respect to said axial direction.

3. The former of claim 1 wherein said constant rate is with respect to the change in position of said contact point between said connecting line and said tangent along said connecting line.

4. The former of claim 1 wherein said connecting line becomes a parabola if said tubular part is cut along a line parallel to said axial direction and is flattened.

5. The former of claim 4 wherein the shape of said parabola is determined in part by a specified difference in height between the highest and lowest points on said connecting line measured along said axial direction.

6. The former of claim 1 wherein said connecting line becomes a hyperbolic function curve if said tubular part is cut along a line parallel to said axial direction and is flattened.

7. The former of claim 6 wherein the shape of said hyperbolic sine curve is determined in part by a specified difference in height between the highest and lowest points on said connecting line measured along said axial direction.

8. A packaging machine comprising:

a web supporting means supporting a web roll having a web of a bag-making material wounde around a core shaft;

a former for forming said web into a tubular shape;

web guiding means for guiding said web from said web roll to said former and said tubularly formed web in a longitudinal direction;

a longitudinal sealer for sealing side edges of said tubularly formed web together in said longitudinal direction; and a transverse sealer having a pair of sealing means for compressing and sealing sheets of said tubularly formed web together therebetween transversely to said longitudinal direction and thereby forming a bag;

said former including a hollow cylindrical tubular part having an inner surface and defining an axial direction and a shoulder part which has a planar guide section and is connected to said tubular part along a connecting line which surrounds said tubular part such that said material is transported over said planar guide section of said shoulder part, changes direction of motion sharply at said connecting line into said axial direction and is transformed into a tubular form along said inner surface of said tubular part, the angle between a tangent to said connecting line tangentially contacting said connecting line at a contact point and a plane perpendicular to said axial direction changing at a constant rate.

9. The packaging machine of claim 8 wherein said constant rate is with respect to the perpendicular component of change in position of said contact point between said connecting line and said tangent with respect to said axial direction.

10. The packaging machine of claim 8 wherein said constant rate is with respect to the change in position of said contact point between said connecting line and said tangent along said connecting line.

11. The packaging machine of claim 8 wherein said connecting line becomes a parabola if said tubular part is cut along a line parallel to said axial direction and is flattened.

12. The packaging machine of claim 11 wherein the shape of said parabola is determined in part by a specified difference in height between the highest and lowest points on said connecting line measured along said axial direction.

13. The packaging machine of claim 8 wherein said connecting line becomes a hyperbolic function curve if said tubular part is cut along a line parallel to said axial direction and is flattened.

14. The packaging machine of claim 13 wherein the shape of said hyperbolic sine curve is determined in part by a specified difference in height between the highest and lowest points on said connecting line measured along said axial direction.

* * * * *

UNITED STATES PATENT AND TRADEMARK OFFICE

CERTIFICATE OF CORRECTION

PATENT NO. : 6,428,457 B1
DATED : August 6, 2002
INVENTOR(S) : Fududa et al.

It is certified that error appears in the above-identified patent and that said Letters Patent is hereby corrected as shown below:

Title page,
Item [*] Notice, delete "0" and insert -- 1096 --.

Signed and Sealed this

Twenty-third Day of August, 2005

JON W. DUDAS
*Director of the United States Patent and Trademark Office*